US007481066B2

(12) United States Patent
Schiller et al.

(10) Patent No.: US 7,481,066 B2
(45) Date of Patent: Jan. 27, 2009

(54) VACUUM DEVICE

(75) Inventors: Dirk Schiller, Hürth (DE); Holger Dietz, Köln (DE); Gerhard Wilhelm Walter, Kerpen-Neubottenbroich (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 380 days.

(21) Appl. No.: 10/568,549

(22) PCT Filed: Jul. 14, 2004

(86) PCT No.: PCT/EP2004/007763

§ 371 (c)(1),
(2), (4) Date: Feb. 17, 2006

(87) PCT Pub. No.: WO2005/019744

PCT Pub. Date: Mar. 3, 2005

(65) Prior Publication Data

US 2006/0272338 A1 Dec. 7, 2006

Related U.S. Application Data

(60) Provisional application No. 60/497,002, filed on Aug. 20, 2003.

(51) Int. Cl.
*B01D 8/00* (2006.01)

(52) U.S. Cl. ..... 62/55.5

(58) Field of Classification Search ..... 62/55.5
See application file for complete search history.

(56) References Cited

U.S. PATENT DOCUMENTS

| | | | | |
|---|---|---|---|---|
| 4,461,635 | A * | 7/1984 | Rudebeck | 62/202 |
| 4,546,611 | A * | 10/1985 | Eby et al. | 62/48.2 |
| 5,010,737 | A * | 4/1991 | Okumura et al. | 62/6 |
| 5,386,708 | A | 2/1995 | Kishorenath et al. | 62/55.5 |
| 5,443,548 | A * | 8/1995 | Saho et al. | 62/51.1 |
| 5,775,109 | A | 7/1998 | Eacobacci, Jr. et al. | 62/6 |
| 6,233,948 | B1 * | 5/2001 | Morishita et al. | 62/55.5 |
| 6,574,978 | B2 * | 6/2003 | Flynn et al. | 62/278 |
| 7,127,901 | B2 * | 10/2006 | Dresens et al. | 62/77 |

* cited by examiner

*Primary Examiner*—William C Doerrler
(74) *Attorney, Agent, or Firm*—Fay Sharpe LLP

(57) ABSTRACT

A vacuum device comprises a plurality of cryopumps (10) connected with one or a plurality of vacuum chambers. The cryopumps (10) are connected via media supply conduits (12) and media return conduits (14) with a compressor (16). An adjusting device (18) is connected before at least one of the cryopumps for controlling the amount of media fed to the cryopump. Further, the cryopumps (10) comprise a temperature measuring device. The temperature measuring device and the adjusting device (18) are connected with a controller (28). To allow the desired amount of media to be fed to the cryopumps (10), the adjusting device (18) comprises a throttle (24) in a media supply conduit (12) and a controllable valve in a throttle bypass conduit (22).

9 Claims, 2 Drawing Sheets

VACUUM DEVICE

BACKGROUND

The invention relates to a vacuum device comprising a plurality of cryopumps for producing a vacuum.

Such vacuum devices comprise a plurality of cryopumps normally arranged in parallel to each other, said cryopumps being connected with one or a plurality of vacuum chambers. Further, the vacuum device comprises a compressor means with the aid of which the cooling media, normally helium, is compressed. The compressed cooling media is fed via media supply conduits to the cryopumps, expands in the cryopump, and is then returned via media return conduits to the compressor means. Cleaning means may be provided in the media conduit for removing e.g. oil or other contaminants from the media. In this manner, contaminants contained in the media are prevented from entering the cryopumps.

Normally, the cryopumps employed are two-stage cryopumps which operate according to the Gifford McMahon principle. In the cryopump one piston, a shared piston where appropriate, is normally provided for each stage. During each piston stroke a cooling media is transported, and the two stages are cooled correspondingly. For example, radiation heat or other temperature influences may heat up individual pumps. Further, there exists the problem that due to the higher density of a lower-temperature gas, a colder cryopump is capable of processing a larger amount of helium per stroke than a warmer cryopump. Consequently, the available amount of helium, which is limited by the compressor capacity, is consumed to a larger extent by the colder cryopumps such that the amount of gas available for the warmer cryopumps is reduced. As a result, cooling of cryopumps, which are too warm, takes a relatively long time.

According to U.S. Pat. No. 5,775,109 this problem is solved by controlling the gas flow. This control can be effected by heating up the cryopump to prevent the pump from delivering an increased amount of cooling media. Further, the velocity of the piston can be reduced, or the piston can be stopped. This however has the drawback that the thermodynamic efficiency decreases since the coolers are adjusted to a specific frequency. The cooling energy stored in the helium is thus not completely utilized.

It is an object of the invention to provide a vacuum device comprising a plurality of cryopumps, wherein the temperature of the cryopump can be controlled in an easy and rapid manner.

SUMMARY

The vacuum device according to the invention comprises a plurality of cryopumps connected with one or a plurality of vacuum chambers. Preferably, these pumps are cryopumps operating according to the Gifford McMahon principle and preferably comprising a cooling head. With the aid of a compressor means connected via media supply conduits and media return conduits with the cryopumps, helium at at least two different pressure levels can be provided in the cryopumps. A vacuum device according to the invention can in particular comprise more than five, possibly even more than ten cryopumps arranged in parallel to each other. Such systems further comprise a compressor means having a plurality, for example two or three, compressors, in particular helium compressors. This results in a relatively high energy requirement of, for example, 10 to 20 kW. Further, the vacuum device comprises at least one adjusting means which is connected directly before, i.e. is associated with, a cryopump. With the aid of the adjusting means the amount of helium fed to the cryopump can be controlled. For this purpose, the adjusting means is connected with a controller. Further, a temperature measuring device is provided which is connected with the cryopump and measures in particular the temperature of the two stages.

The adjusting means according to the invention is arranged in a media supply conduit of a cryopump and comprises a throttle device disposed in the media supply conduit. Further, the adjusting means comprises a branch or a throttle bypass bridging the throttle means. In the throttle bypass conduit a valve is arranged. This valve can be controlled by the controller. Thus, with the aid of the adjusting means according to the invention in particular two media supply states towards the cryopump can be realized. In one state, the valve arranged in the bypass conduit is closed such that media can flow only via the throttle means to the cryopump. In another position, the valve is completely open such that a maximum amount of media can flow through the bypass conduit to the cryopump. In a simple embodiment, the valve can be configured as a switch-over valve comprising only the two states "fully closed" or "fully open".

With the aid of the controller it is thus possible in a simple manner to feed, by opening the valve, a large amount of cooling media to a cryopump which is too warm. Accordingly, closing or keeping closed valves which are associated with the adequately cold cryopumps prevents too large an amount of cooling media from being consumed by said cold pumps.

In a particularly preferred variant, such an adjusting means according to the invention is associated with a plurality of cryopumps. In particular, an inventive adjusting means is associated with each cryopump of the vacuum device. Thus it can be ensured in a simple manner that a cryopump, which is too warm, can be supplied with a sufficient amount of cooling media such that the desired temperature of the cryopump can be rapidly attained.

In a preferred embodiment, the cross-section of the throttle bypass conduit is selected such that a maximum media supply is possible. The valve provided in the bypass conduit can be configured such that the effective cross-section of the valve and thus the media flow rate can be varied. The valve arranged in the bypass conduit preferably has a cross-sectional diameter of more than 6 mm. The nozzle provided has a cross-sectional diameter of approximately 1 mm.

Further, it is possible to provide a throttle means whose effective cross-sectional area is adjustable. This offers the advantage that the cross-sectional area of the throttle means can be adjusted such that during standard operation the required amount of cooling media can flow through this media supply conduit to the cryopump, and the valve arranged in the bypass conduit can be closed during standard operation. This allows a cryopump, which is too warm e.g. due to heat radiation, to be supplied with a sufficiently large amount of cooling media, in particular helium. A large amount of cooling media is, for example, also necessary during start-up operation.

During standard operation a cryopump normally requires only one third of the maximum amount of cooling media for keeping constant the temperature in the first and the second stage. With the aid of the vacuum device according to the invention it is thus possible to reduce the capacity of the compressor means since the present invention allows for a lower overall cooling agent consumption or cooling agent flow at peak loads of individual cryopumps arranged in a network. Further, the present invention allows a reserve to be created when compressors with constant capacity are employed.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF THE PREFERRED EMBODIMENTS

Figure 1:
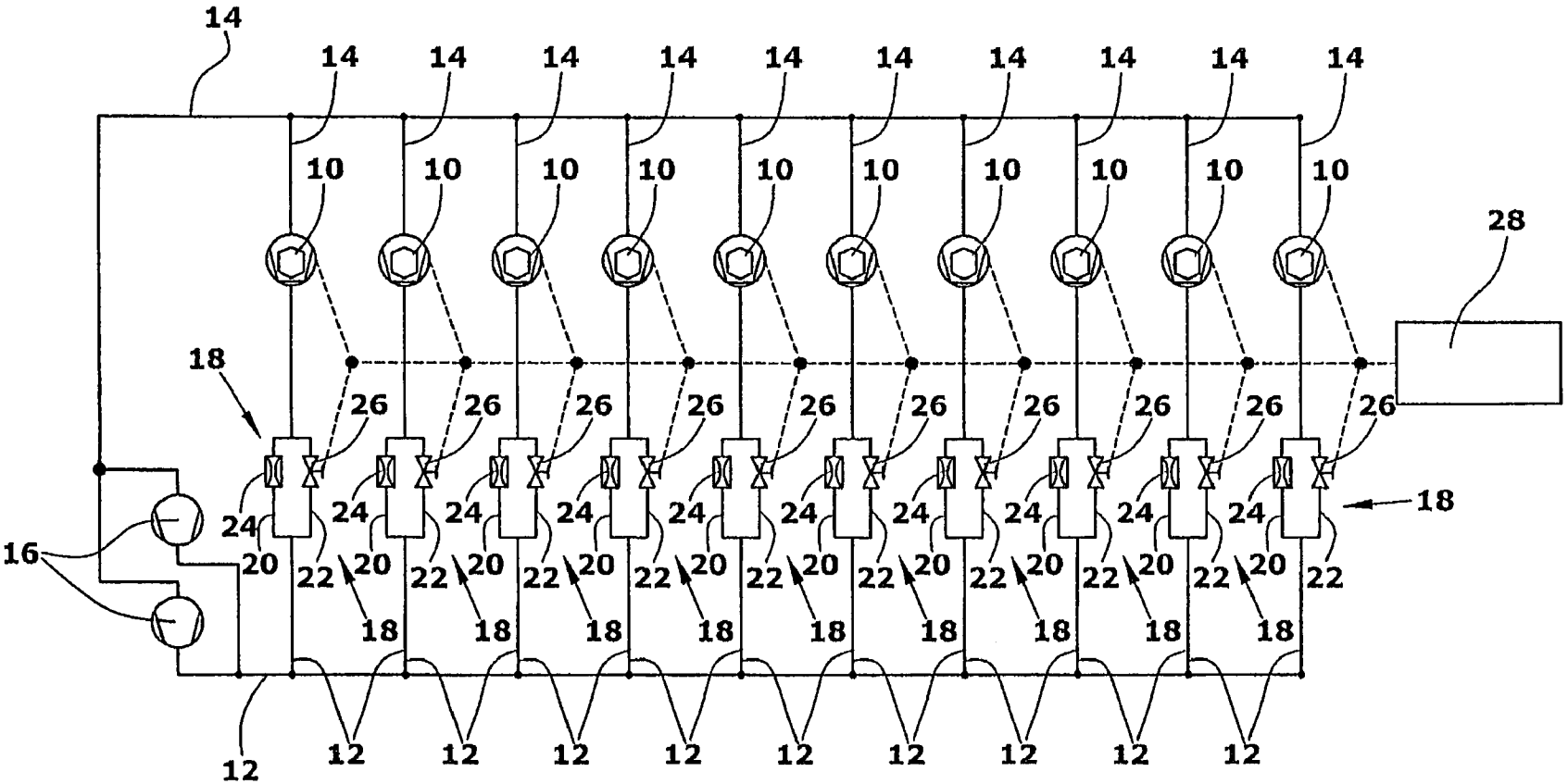
FIG. 1 shows a schematic diagram of a vacuum device according to the present invention.

The vacuum device comprises a plurality of cryopumps 10 which are connected with one or a plurality of vacuum chambers (not shown). The cryopumps 10 are arranged in parallel to each other, and are connected via media supply conduits 12 and media return conduits 14 with a compressor means comprising two compressors 16.

In the individual media supply conduits 12, which are directly associated with a cryopump 10, one adjusting means 18 each is provided for controlling the amount of media fed to the cryopump. The adjusting means 18 comprises a branch of the media supply conduit 12 into two conduits 20, 22 extending in parallel to each other. In the first conduit 20 a throttle means 24 and in the second conduit 22 a valve 26 is provided.

In the illustrated embodiment, the individual valves 26 are connected via an electrical conduit, shown by a broken line, with a controller 28. The controller 28 has further connected thereto via electrical conduits, also shown by a broken line, temperature measuring devices arranged in the cryopumps 10.

In the illustrated embodiment, the throttle device 24 is not variable but comprises a constant cross-section. Further, the valve 16 is a switch-over valve which can either be closed or open. This valve does not comprise an intermediate position.

Figure 2:
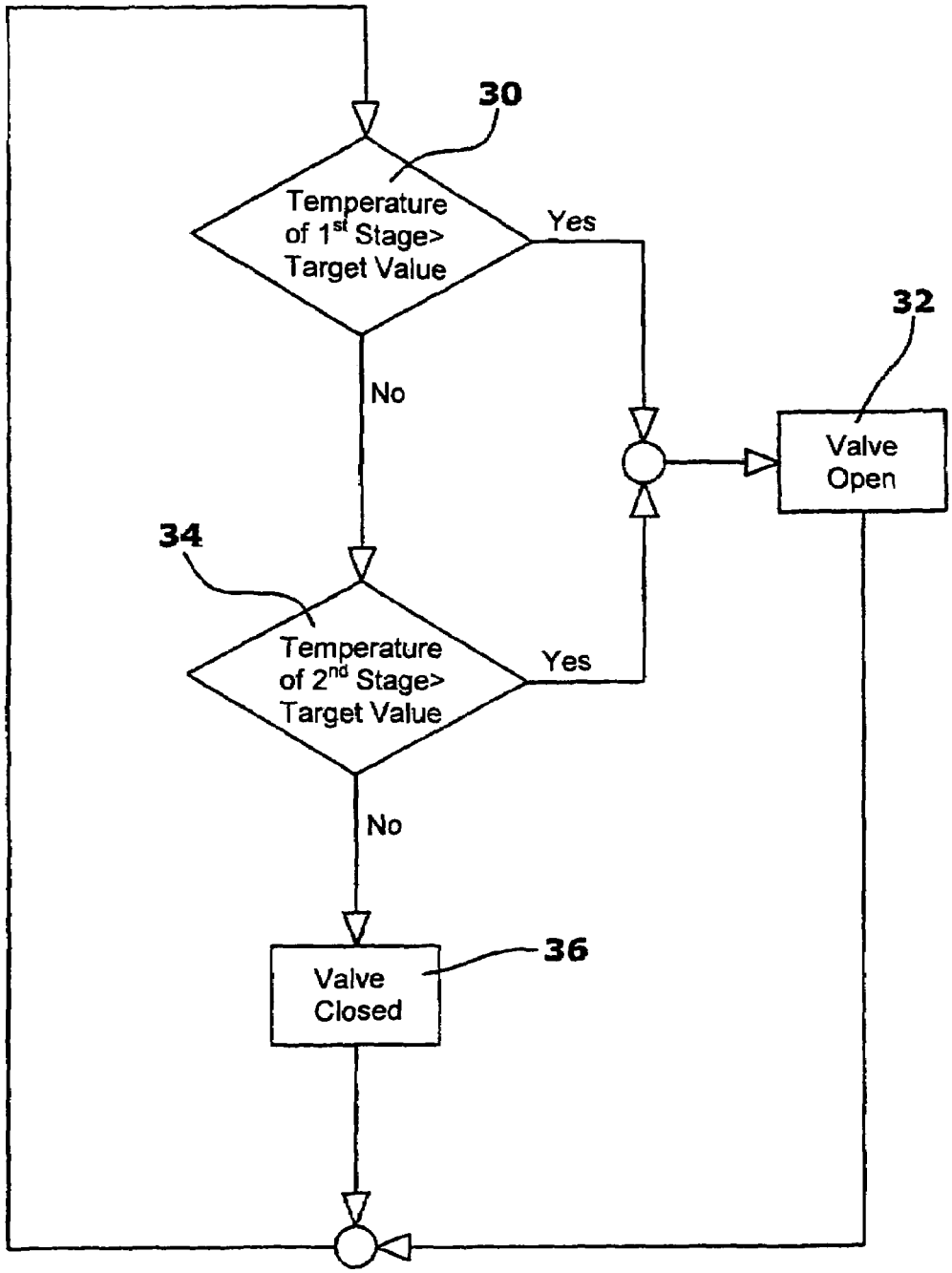
FIG. 2 shows a schematic flow chart of the control of the valve arranged in the throttle bypass conduit.

An exemplary function of the controller 28 is shown in FIG. 2. Here, in a first step 30 the temperature of a first stage of a specific cryopump 10 is compared with a target value. If the measured temperature of the first stage exceeds the target value, i.e. if the first stage of the cryopump 10 is too warm, the question must be answered with "yes" such that in step 32 the respective valve 26 is opened.

If the temperature of the first stage does not exceed the target value, the temperature of the second stage is checked with regard to a second target value in step 34, said second target value differing from the first target value checked in step 30. As in step 30, a "yes" decision is made if the temperature of the second stage exceeds the target value, i.e. the second stage is too warm. Consequently, in step 32 the valve 26 is opened.

If the second stage is cold enough, too, and does thus not exceed the target value, a "no" decision is made, and the valve remains closed (step 36).

The inquiry described above of the individual cryopumps is carried out at regular intervals. The control of the valves can be further improved, in particular in the case of valves which can also be partly opened and closed. For this purpose, for example, further target values and/or threshold values are defined.

The invention has been described with reference to the preferred embodiments. Modifications and alterations may occur to others upon reading and understanding the preceding detailed description. It is intended that the invention be constructed as including all such modifications and alterations in-sofar as they come within the scope of the appended claims or the equivalents thereof.

The invention claimed is:

1. A vacuum device comprising:

a plurality of cryopumps connected with one or more vacuum chambers, a compressor means connected via media supply conduits and media return conduits with the plurality of cryopumps, an adjusting means connected before each of at least one of the cryopumps for controlling the amount of media fed to the corresponding cryopump during cooling, the adjusting means including a throttle device arranged in the corresponding media supply conduit to supply the cryopump with a first amount of media and a valve in a bypass conduit to increase the supply of the media to the corresponding cryopump, a temperature measuring device connected with each of the at least one cryopumps, and a controller connected with the adjusting means and the temperature measuring device of each of the at least one cryopumps, wherein in response to a temperature of one of the cryopumps rising, the controller controls the valve in the corresponding bypass conduit to increase the media supplied and reduce the temperature of the corresponding cryopump.

2. The vacuum device according to claim 1, wherein the cross-section of a throttle bypass conduit is designed for a maximum media supply.

3. The vacuum device according to claim 1, wherein the throttle device has a cross-section designed for the media supply required for standard operation.

4. The vacuum device according to claim 1, wherein the cross-sectional area of the throttle device is adjustable.

5. The vacuum device according to claim 1, wherein the flow rate through the valve in the bypass line is adjustable.

6. The vacuum device according to claim 1, further including an adjusting means connected before each cryopump.

7. A vacuum system comprising:

a plurality of cryopumps connected with a vacuum chamber, each cryopump including a temperature sensor;

a plurality of supply conduits which supply a gaseous cooling medium to the plurality of cryopumps;

a plurality of adjustable valve assemblies in the supply conduits which adjustably control an amount of the gaseous cooling medium supplied to a corresponding vacuum pump;

a controller connected with the temperature sensors and the adjustable valve assemblies, the controller controlling each valve assembly in accordance with a sensed temperature of a corresponding cryopump supplied by the valve assembly wherein the controller causes each valve assembly to:

supply a preselected amount of the cooling medium when a sensed temperature of the corresponding cryopump is below a target temperature; and, increase the amount of the supplied cooling medium when the sensed temperature is warmer than the target temperature.

8. The vacuum system according to claim 7 wherein the adjustable valve assemblies each comprise:

a first conduit which throttles the gaseous cooling medium to supply the preselected amount;

a second conduit in parallel with the first to supply more than the preselected amount of the compressed cooling medium; and, a control valve in the second conduit which controls the supply of the compressed cooling medium through the second conduit.

9. In a vacuum system including a plurality of cryopumps, each cryopump including a temperature sensor, a plurality of supply conduits which supply a compressed cooling medium to the plurality of cryopumps, a plurality of adjustable valve assemblies in the supply conduits which adjustably control an amount of the compressed cooling medium supplied to an associated vacuum pump, a controller programmed to:

control the valve assemblies to supply a preselected amount of the cooling medium when a sensed temperature of the corresponding cryopump is below a target temperature; and, control each one of the valve assemblies to increase the supplied amount of the cooling medium to its corresponding cryopump when the sensed temperature of the corresponding cryopump is warmer than the target temperature.

* * * * *